US005611578A

United States Patent [19]

Angelico, Sr. et al.

[11] Patent Number: 5,611,578

[45] Date of Patent: Mar. 18, 1997

[54] TOOL FOR TYING KNOTS IN BALLOONS

[76] Inventors: Henry R. Angelico, Sr.; Henry R. Angelico, Jr.; Brian A. Angelico, all of 306 Oak Track Radial, Ocala, Fla. 34472

[21] Appl. No.: 588,264

[22] Filed: Jan. 18, 1996

[51] Int. Cl.[6] ..... D03J 3/00

[52] U.S. Cl. ..... 289/17

[58] Field of Search ..... 289/17, 18.1, 2; 446/220, 222

[56] References Cited

U.S. PATENT DOCUMENTS

| | | | |
|---|---|---|---|
| 2,697,624 | 12/1954 | Thomas et al. | 289/17 |
| 2,758,858 | 8/1956 | Smith, Sr. | 289/17 |
| 3,494,648 | 2/1970 | Stephens | 289/17 |
| 3,630,555 | 12/1971 | Newlin | 289/17 |
| 3,752,516 | 8/1973 | Mumma | 289/17 |
| 3,837,691 | 9/1974 | Smythe | 289/17 |
| 4,532,054 | 7/1985 | Johnson | 252/12.4 |
| 4,864,762 | 9/1989 | Cox | 289/17 |
| 4,917,355 | 4/1990 | Dark et al. | 251/214 |
| 4,989,906 | 2/1991 | Peverley | 289/17 |
| 5,039,142 | 8/1991 | Muma | 289/17 |
| 5,114,091 | 5/1992 | Peterson et al. | 242/107.11 |
| 5,314,217 | 5/1994 | Place | 289/17 |
| 5,383,695 | 1/1995 | Couper | 289/17 |

*Primary Examiner*—Michael A. Neas
*Attorney, Agent, or Firm*—Richard L. Huff

[57] ABSTRACT

A tool for tying knots in the necks of inflatable objects, such as balloons. The tool is an elongated member having two side surfaces, a top surface, a bottom surface, and opposing tapered ends. Each tapered end contains a recessed area in the top surface. There is a receiving slit in each recessed area. The distal portion of the receiving slit may have a "V" shape to increase ease of access of the balloon neck. The tool is made of a lubricating plastic, such as a mixture of ABS rubber and at least one of high density polyethylene, high density polypropylene, and silicone in order to decrease the friction between the tool and the ballon. To further decrease friction between the tool and the balloon, the tool contains small protrusions or dimples which decrease the surface area of contact.

5 Claims, 5 Drawing Sheets

TOOL FOR TYING KNOTS IN BALLOONS

BACKGROUND OF THE INVENTION

1. Field of the Invention.

This invention is directed to a tool to aid in the tying of knots in the necks of balloons and other inflated objects.

2. Description of the Related Art

When one attempts to tie a knot in the neck of a balloon or other inflated object, there is the difficulty of stretching the neck to sufficient length to tie a knot, while at the same time preventing air from escaping. Furthermore, if the individual attempting to tie such a knot is infirm (for example, with arthritis or other joint or muscle crippling disease) or uncoordinated (for example, a young child, a person with Parkinson's disease, etc.), then the difficulty is compounded. Finally, those who tie many such knots in a short time period (for example, a vendor selling helium-filled balloons) risk the discomforts that may develop from chafing of the skin on the fingers due to hand-tying the non-slippery surface of the balloon or other inflatable object.

The prior art teaches tools for tying knots in balloons. The closest prior art in this field known by the present inventors is Muma's U.S. Pat. No. 5,039,142. The tying tool disclosed in this patent consists of a flat rectangular implement with two parallel slits at one end. The center-most slit connects with a shallow recess on one of the two flat sides. Although this tool is a substantial and significant improvement over the tying of knots by hand, it is complicated to use, the balloon is not firmly held on the tool during the tying process, the balloon is difficult to remove from the tool following tying, and it is not adapted to receive a variety of balloon sizes.

SUMMARY OF THE INVENTION

The present invention seeks to overcome these drawbacks by providing a tool for tying knots in balloons or other inflated objects that is geometrically designed for easier tying due to a deeper recessed area at the tying location on the tool, has a tapered construction which allows the formed knot to easily slip off the tool, contains two differently sized slits which may have "V"-shaped ends for easier access to better receive balloon necks having various sizes, is made of a lubricating plastic which permits easy release of the formed knot, and contains rounded protrusions or dimples at the area in contact with the balloon to decrease the surface area of the tool which is in contact with the balloon, and therefore decrease the friction between the tool and the balloon.

DESCRIPTION OF THE PREFERRED EMBODIMENTS

While the following description makes reference to balloons, it is to be understood that the tool of the present invention may be used for tying knots in other inflatable objects which have a body and a neck. Examples of such inflatable items are toys, inner tubes, air mattresses, and furniture.

Figure 1:
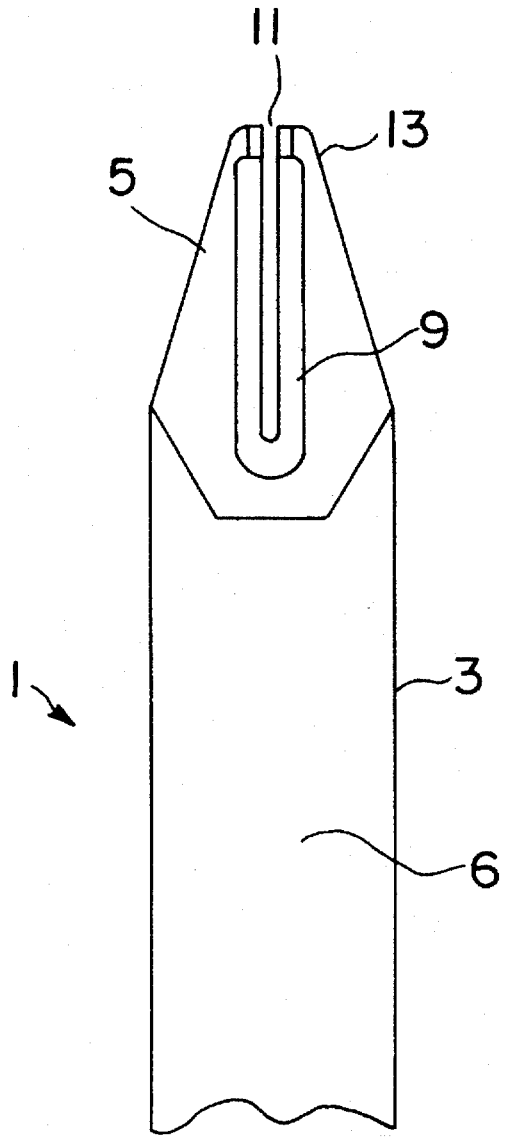
FIG. 1 is an overhead plan view of one end of the knot tying tool of this invention.
Figures 2, 3:
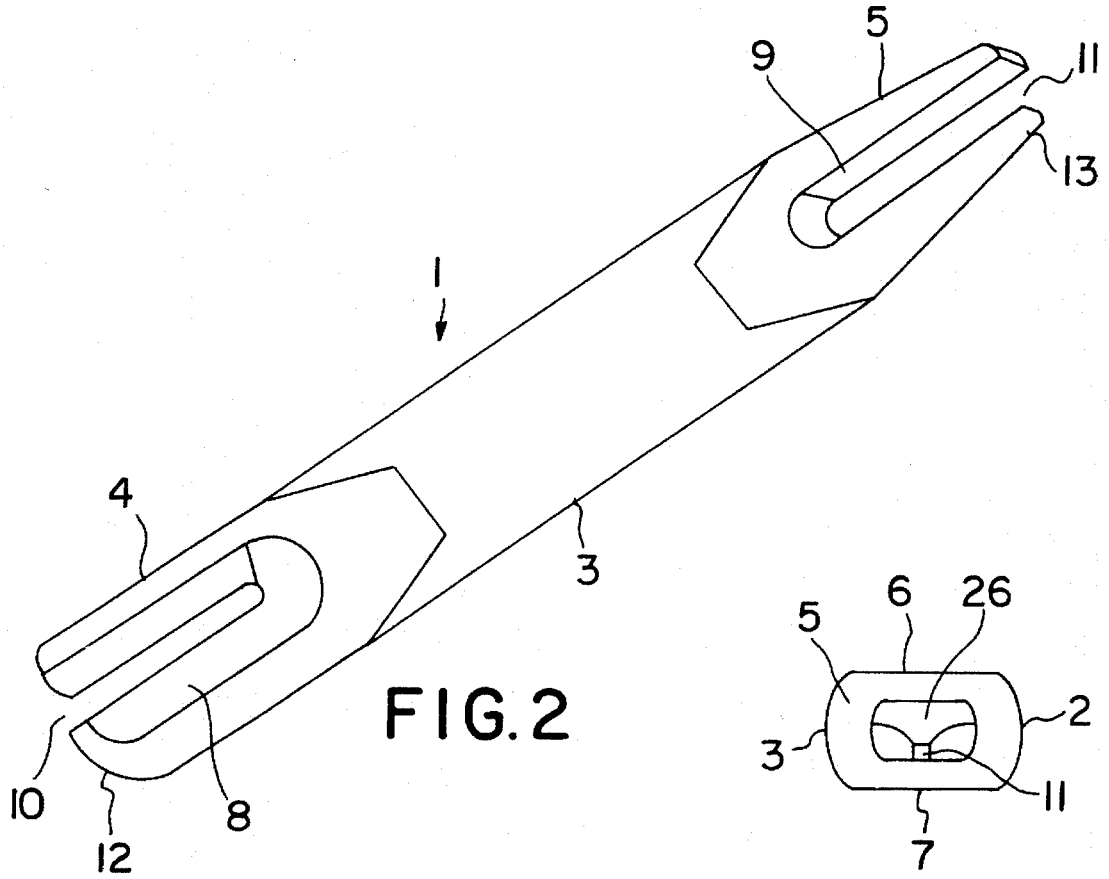
FIG. 2 is a perspective view of the knot tying tool of this invention.
FIG. 3 is an end view of the knot tying tool of this invention.

Referring to FIGS. 1–3, the tying tool 1 contains an elongated member having two side surfaces 2, 3, opposing tapered ends 4, 5, a top surface 6, a bottom surface 7, recessed areas 8, 9 in the front surface of the tapered ends 4, 5, receiving slits 10, 11 in the recessed areas 8, 9, and tips 12, 13 of the tapered ends 4 and 5.

One recessed area 8 is shallower and narrower than the opposing recessed area 9. This difference in sizes of the recessed areas 8, 9 allows the tool 1 to accept balloons which are of different sizes and have different sized annular rings at the end of the necks.

One slit 10 is narrower than the opposing slit 11 to allow the tool 1 to accept balloons of different neck widths. Thus, the single tool 1 of our invention may be used for tying knots in balloons having a wide variety of sizes. At least one slit 10, 11 may have a distal end which is widened to form a "V" shape. This allows for easier access of the balloon neck during the knot-tying process.

The tools 1 of the present invention are made of lubricating plastic, preferably a mixture of ABS and at least one member selected from the group consisting of high density polyethylene, high density polypropylene, and silicone. More preferably the lubricating plastic is a mixture containing 90–99% by weight ABS rubber and 1–10% by weight of at least one member selected from the group consisting of high density polyethylene, high density polypropylene, and silicone. Most preferably, 90% by weight of the ABS rubber and 10% by weight of at least one member selected from the group consisting of high density polyethylene, high density polypropylene, and silicone are used. The preferred embodiment known to the inventors contains 90% by weight ABS rubber and 10% by weight of a mixture containing equal parts by weight of high density polyethylene, high density polypropylene, and silicone. The polyethylene, polypropylene and silicone have been found to increase the slipperyness of the tool 1, and therefore allow the knoted neck to be removed from the tool 1 easier than if only ABS were used.

The tool is made by molding a liquid mixture of the above ingredients.

Figure 4:
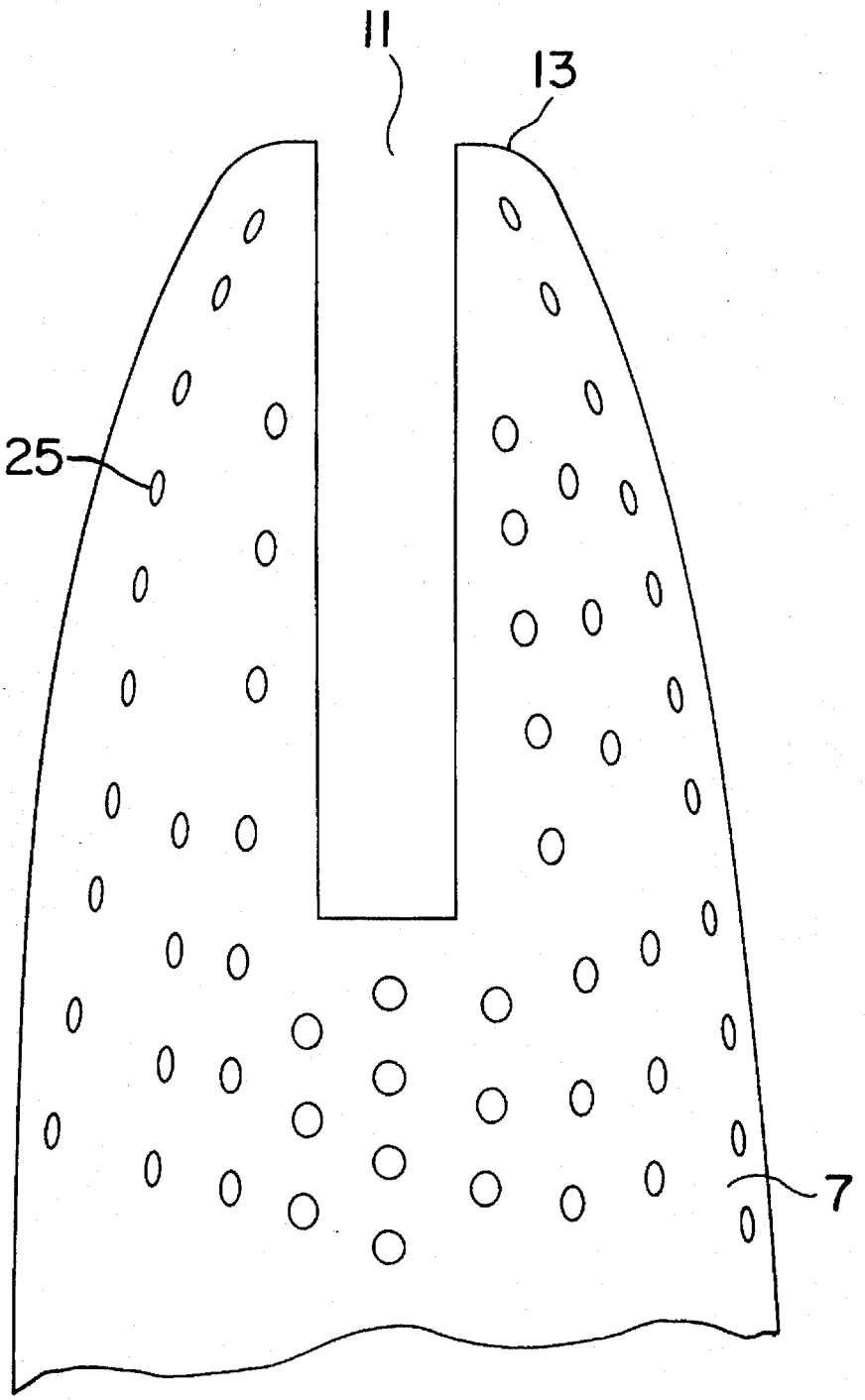
FIG. 4 is an enlarged pespective view of the back surface of a tapered end showing protrusions.

An additional method of decreasing the friction between the tool 1 and the balloon neck 22, 22' is shown in FIG. 4. The presence of small rounded protrusions 25 on at least one surface of at least one tapered end 4, 5 decreases the amount of tool surface area in direct contact with the balloon neck 22, 22', and thereby decreases the amount of friction between the balloon neck 22, 22' and the tool 1. This enables the knotted balloon 20 to be removed easily from the tool 1. Much the same effect is achieved with the use of dimples (not shown) in the surface of at least one tapered end 4, 5.

The method of using the tool 1 is described with reference to FIGS. 5–9. For purposes of illustration, the section of the neck 22 closest to the body 21 of the balloon 20 maintains the designation 22, and the section closest to the open end containing an annular ring 24 is designated 22'. FIG. 9 shows the finished product as being a balloon 20 having a body 21, a neck 22, a knot 23, and an open end containing an annular ring 24 at the end of the neck 22'.

Figure 5:
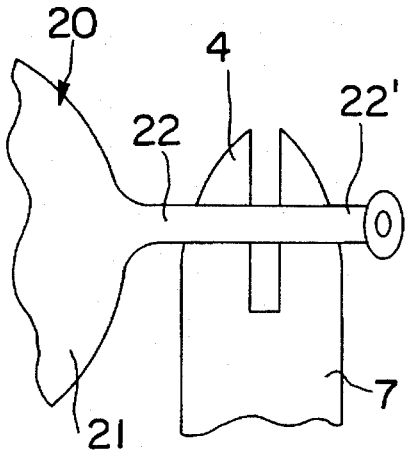
FIGS. 5–9 illustrate the use of the knot tying tool of the present invention to form a knot in the neck of an inflated balloon.

FIG. 5 shows the initial position of the balloon 20, on the tool 1. The neck 22, 22' of the balloon 20 is positioned over the tapered end 4 on the bottom surface 7 of the tool 1 and held in place with, for example, a thumb and forefinger of the right hand.

Figure 6:
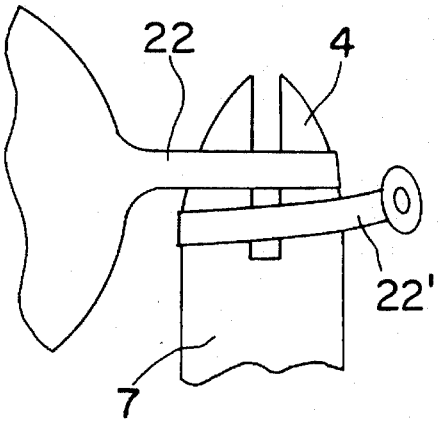

FIG. 6 shows the loop of the neck 22 around the tapered end 4 of the tool 1. With the balloon 20 in the position shown in FIG. 5, the neck 22 of the balloon 20 is stretched with, for example, the left hand, around the tapered end 4 of the tool 1 and brought to a position along side and parallel to the neck 22' as it was shown in FIG. 5. The looped portion of the neck 22 should be nearer the tip 12 than is the neck 22' in the original position. The body 21 of the balloon 20 will be in the position shown in FIG. 5.

Figure 7:
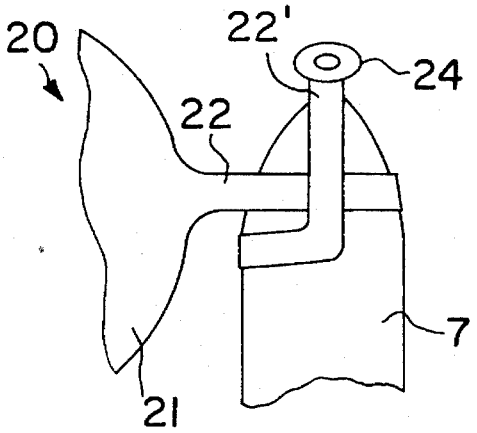

FIG. 7 shows the positioning of the open end having an annular ring 24 of the balloon 20 into the receiving slit 10. With the balloon 20 and tool 1 in the position described in FIG. 6, that portion of the neck 22' having the open end having an annular ring 24 is stretched over the looped portion of the neck 22 and is positioned through the receiving slit 10.

Figure 8:
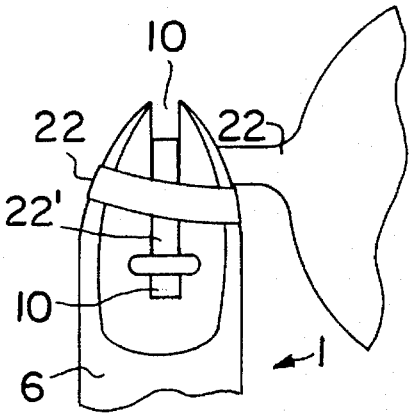
Figure 9:
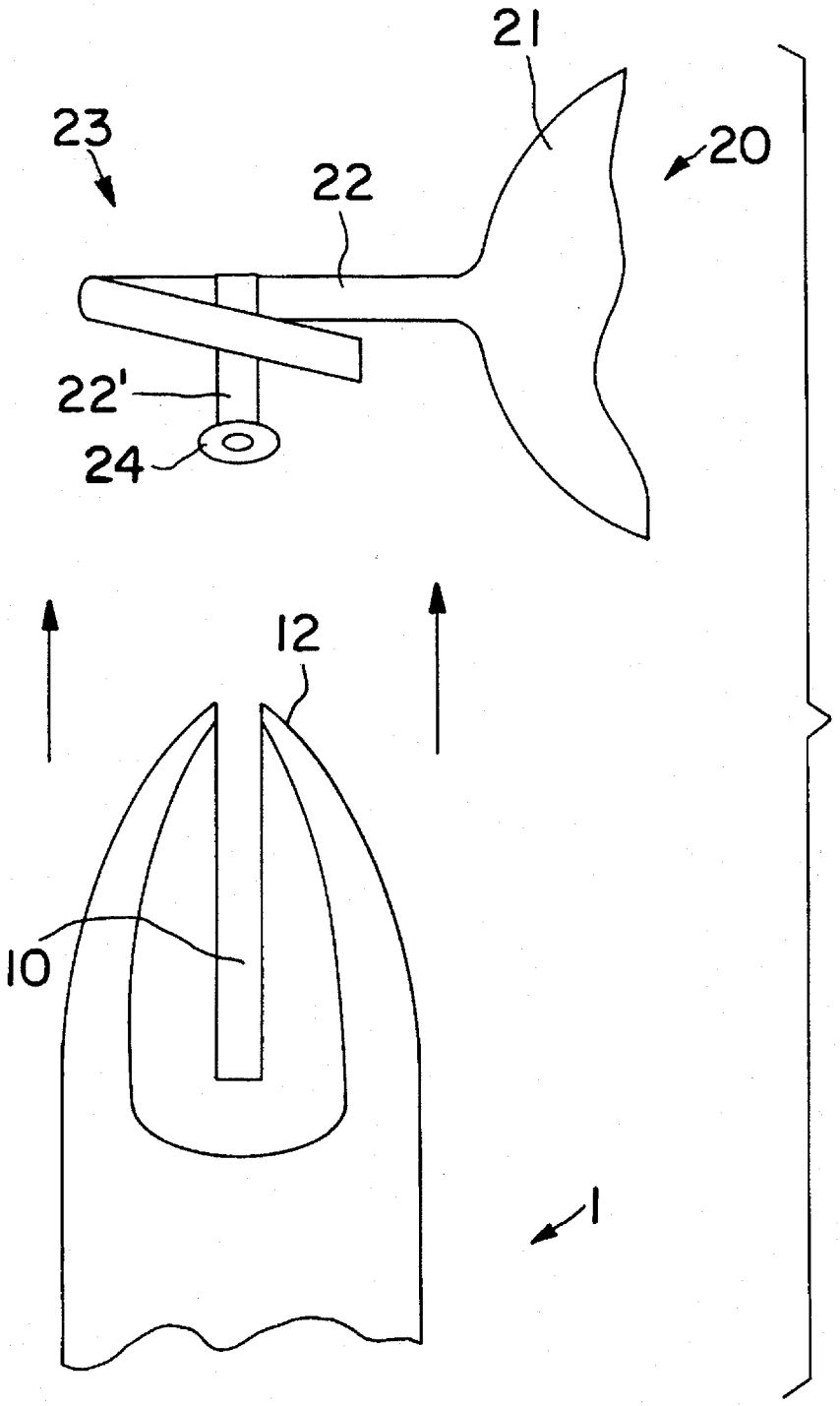

FIG. 8 shows the positioning of the open end having an annular ring 24 in the recessed area 8. With the neck 22 in the position shown in FIG. 7, the neck 22' and the open end having an annular ring 24 is taken through the slit 10, between the looped portion of the neck 22 and the tool 1 and into the recessed area 8. This maneuver forms a knot 23 in the neck 22.

FIG. 9 shows the removal of the knotted neck 22 from the tool 1. Once the knot 23 is formed as in FIG. 8, the balloon 20 may be rolled toward the tip 12 and off of the tool 1. After the balloon 20 is released from the tool 1, the knot 23 should be tightened to ensure the prevention of leakage of gas from the balloon 20.

We claim:

1. A tool for tying knots in the necks of inflatable objects having bodies and necks, which tool is made of a lubricating plastic, and which tool comprises an elongated member having two side surfaces, opposing tapered ends having distal ends, a top surface, a bottom surface, a recessed area in the top surface of each tapered end, wherein the distal ends of the tapered ends have raised edges on the top surfaces partially enclosing the recessed area, and a receiving slit in each recessed area, wherein one recessed area is shallower and narrower than the opposing recessed area, one receiving slit is narrower than the opposing receiving slit, and wherein the two side surfaces and the bottom surface of each tapered end contains protrusions.

2. The tool of claim 1, wherein the distal end of at least one slit has a "V" shape.

3. The tool of claim 1, wherein the lubricating plastic comprises a mixture of ABS rubber and at least one member selected from the group consisting of high density polyethylene, high density polypropylene, and silicone.

4. The tool of claim 3, wherein the lubricating plastic comprises 90–99% by weight ABS rubber and 1–10% by weight of at least one member selected from the group consisting of high density polyethylene, high density polypropylene, and silicone.

5. The tool of claim 4, wherein the lubricating plastic comprises 90–99% by weight of ABS rubber and 1–10% by weight of a combination containing substantially equal parts by weight of high density polyethylene, high density polypropylene, and silicone.

* * * * *